US008136285B2

(12) United States Patent
Abell et al.

(10) Patent No.: US 8,136,285 B2
(45) Date of Patent: Mar. 20, 2012

(54) FIREARM CARTRIDGE SPEED LOADER

(76) Inventors: Paul C. Abell, Leonardtown, MD (US); Steven T. Coryell, California, MD (US)

( * ) Notice: Subject to any disclaimer, the term of this patent is extended or adjusted under 35 U.S.C. 154(b) by 280 days.

(21) Appl. No.: 12/654,170

(22) Filed: Dec. 11, 2009

(65) Prior Publication Data

US 2011/0138672 A1 Jun. 16, 2011

(51) Int. Cl.
*F41A 9/61* (2006.01)

(52) U.S. Cl. ..... 42/89; 224/198

(58) Field of Classification Search ..... 42/88, 89; 224/197–200, 223, 239
See application file for complete search history.

(56) References Cited

U.S. PATENT DOCUMENTS

| | | | | | |
|---|---|---|---|---|---|
| 2,399,904 | A | * | 5/1946 | Baucum | 42/89 |
| 2,944,359 | A | * | 7/1960 | Hanley | 42/89 |
| 3,541,716 | A | * | 11/1970 | Fordham et al. | 42/89 |
| 3,722,125 | A | * | 3/1973 | Switzer | 42/89 |
| 4,065,868 | A | | 1/1978 | Johnson | |
| 4,202,124 | A | * | 5/1980 | Switzer | 42/89 |
| 4,313,275 | A | * | 2/1982 | Switzer | 42/89 |
| 4,796,371 | A | * | 1/1989 | Daniels | 42/89 |
| 4,866,870 | A | * | 9/1989 | Johnson | 42/89 |
| 5,842,299 | A | * | 12/1998 | Switzer et al. | 42/89 |
| 5,953,845 | A | * | 9/1999 | Longwitz | 42/89 |
| 6,308,451 | B1 | * | 10/2001 | Koledey | 42/89 |
| 6,665,974 | B1 | * | 12/2003 | Anderson | 42/89 |
| 6,688,504 | B1 | * | 2/2004 | Kirkaldy | 224/196 |
| 2006/0101698 | A1 | * | 5/2006 | Lin | 42/89 |

FOREIGN PATENT DOCUMENTS

WO WO 94/12842 6/1994

OTHER PUBLICATIONS

"HKS Speedloaders for Revolvers", Pistoleer.com, http://www.pistoleer.com/hks/revolver/, 2 of 5 pages printed from the Interneet on Jul. 9, 2008.

* cited by examiner

*Primary Examiner* — Michael Carone
*Assistant Examiner* — Samir Abdosh
(74) *Attorney, Agent, or Firm* — Richard C. Litman

(57) ABSTRACT

The firearm cartridge speed loader includes a shaft, a reload cylinder, and a rotation limit assembly at an interface between the shaft and cylinder. The reload cylinder has a plurality of pockets or chambers to hold bullet or ammunition cartridges, and the shaft includes an interference wheel configured to selectively clamp the cartridges in the pockets by simple rotation of the shaft within the limits defined by the rotation limit assembly. The rotation limit assembly includes a rotation-stop pin riding in an arcuate slot that defines the limits of shaft rotation, and a spring loaded spherical ball that selectively engages one of two detents to lock the shaft into the clamping or releasing positions, the disposition of the detents corresponding to the defined limits of the arcuate groove.

13 Claims, 7 Drawing Sheets

FIREARM CARTRIDGE SPEED LOADER

BACKGROUND OF THE INVENTION

1. Field of the Invention

The present invention relates to firearms, and more particularly to a firearm cartridge speed loader for revolvers having a relative simple configuration that offers reliable, fast loading of fresh cartridges with minimal effort.

2. Description of the Related Art

Hand held firearms have been a great means of self-defense and sport for a long time. In either competitive or life threatening situations, time is one of the most critical factors to consider when a person must reload a firearm. Every second spent in reloading provides an advantage to an opponent that is potentially fatal or game breaking. Revolvers are particularly susceptible to this type of threat when the cartridges have to be loaded into the chamber of the revolver cylinder one at a time. Reloading devices for revolvers have been proposed to overcome this issue. However, they tend to be complex and/or non-intuitive in operation, both being potentially negative factors in the extremely stressful and life threatening environment of a gunfight.

Thus, a firearm cartridge speed loader solving the aforementioned problems is desired.

SUMMARY OF THE INVENTION

The firearm cartridge speed loader includes a shaft, a reload cylinder, and a rotation limit assembly at an interface between the shaft and cylinder. The reload cylinder has a plurality of pockets or chambers to hold bullets or ammunition cartridges, and the shaft includes an interference wheel configured to selectively retain the cartridges in the pockets by simple rotation of the shaft within the limits defined by the rotation limit assembly.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
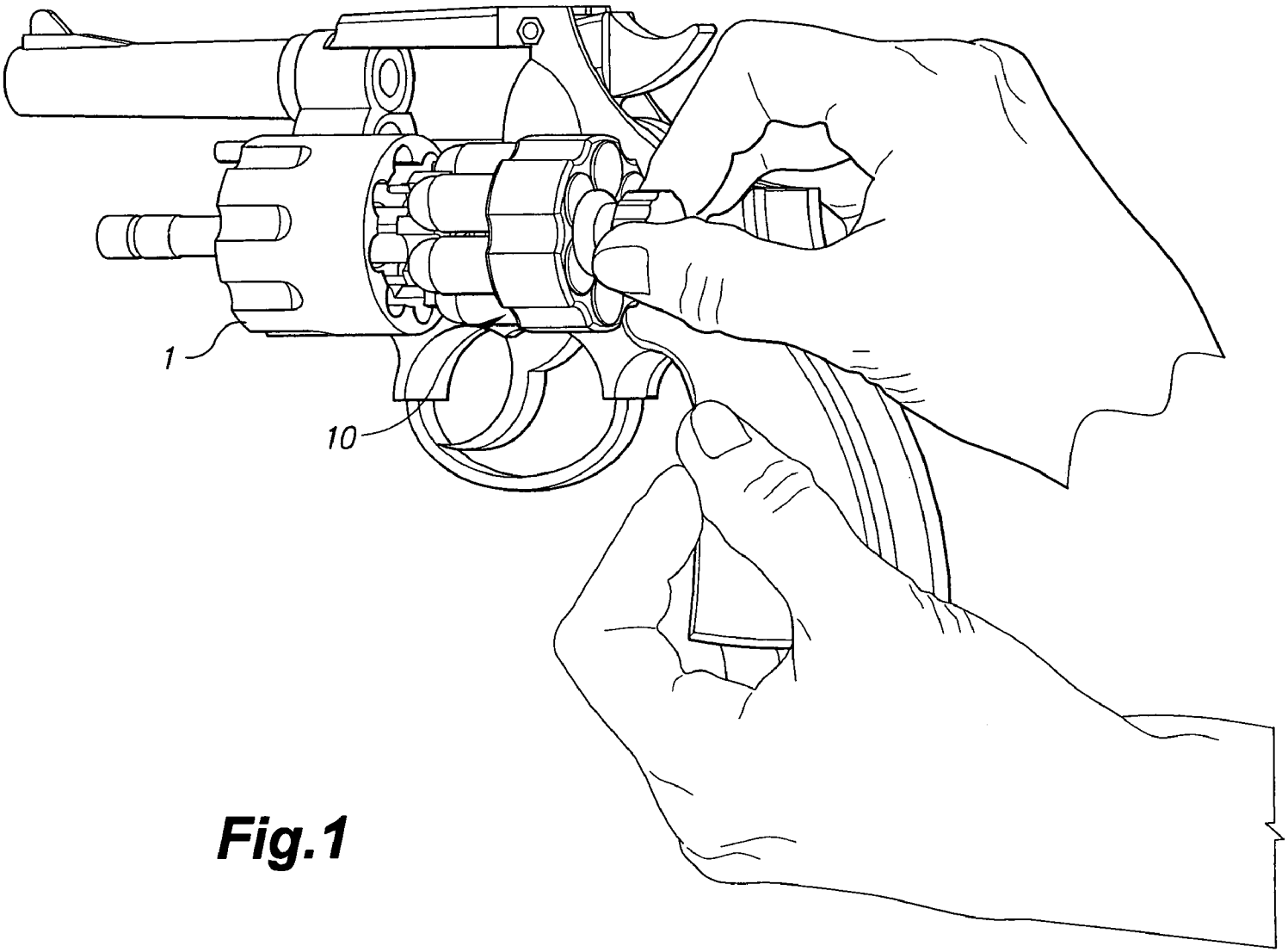
FIG. 1 is an environmental, perspective view of a firearm cartridge speed loader according to the present invention.
Figure 2:
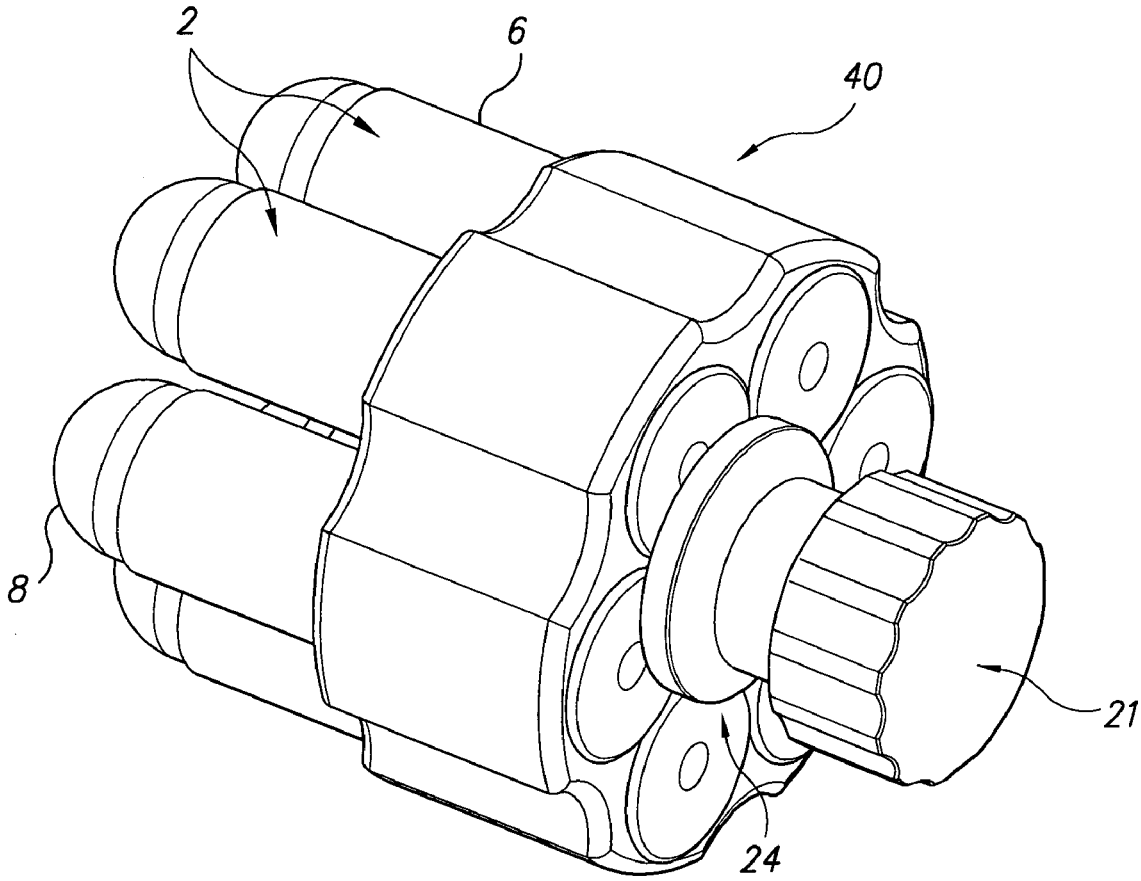
FIG. 2 is an environmental perspective view of the firearm cartridge speed loader of FIG. 1, shown carrying cartridges to be loaded.
Figure 3:
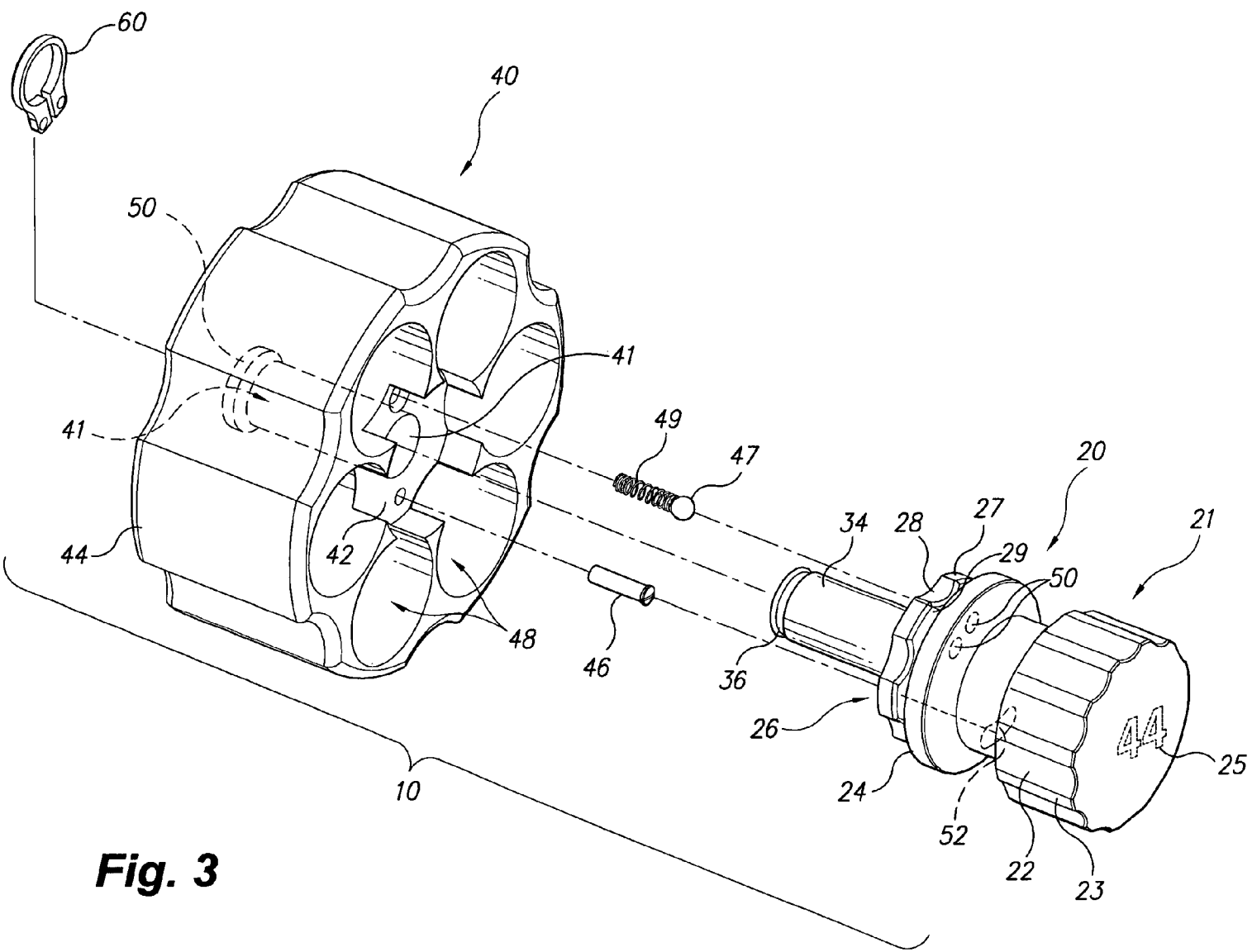
FIG. 3 is an exploded perspective view of the firearm cartridge speed loader according to the present invention.

The present invention relates to a firearm cartridge speed loader 10 for revolvers that is lightweight and simple in construction with minimal parts. As shown in FIGS. 2 and 3, the firearm cartridge speed loader 10 includes a substantially elongated shaft 20 insertably mounted through a central bore 41 in the reload cylinder 40. A retaining clip 60 snaps into an annular groove 36 at one end of the shaft 20 to secure the assembly and prevent the shaft 20 from slipping out of the bore 41.

A first end of the shaft 20 has an enlarged portion forming a knob 21. The knob 21 includes a plurality of curved indentions or scallops 22 equidistantly spaced around the circumference of the knob 21 to form radially extending protuberances 23. These protuberances 23 aid a user in gripping and turning the shaft 20. As an alternative, the knob 21 may be knurled in a variety of different ways to form a rough surface to grip. While the indentions 22 and protuberances 23 function as a gripping aid, they also thematically follow the structure of a revolver cylinder 1. The knob 21 may be rounded for aesthetic appeal, and/or it may include etched, scribed or laser cut indicia 25. The indicia may range from the particular caliber of cartridge for the specific reloader 10 to personalized designs of the name and logo of an organization. The knob 21 is preferably about 0.740 inches in diameter and 0.491 in thickness.

Further along the length of the shaft 20 intermediate the two ends, a stop 24 is formed to prevent the cartridges 2 from slipping out of the respective cylinder chambers 48 in the reload cylinder 40, i.e., when the cartridges 2 are fed into the cylinder chambers 48, the rear of the cartridge 2 (near rim 4) is obstructed from rearward movement back out of the cylinder chamber 48 by the stop 24. The stop 24 is a disk-shaped flange with a diameter large enough to overlie portions of the cylinder chambers 48 in the reload cylinder 40. A representative diameter of the stop 24 is about 0.740 inches. The stop 24 also serves to limit the extent of insertion of the shaft 20 into the reload cylinder 40. One face of the stop 24 has a conical surface while the opposite face is substantially flat to function as the stopping surface.

A star-shaped, gear-shaped, or fluted interference wheel 26 is laterally spaced between the stop 24 and the cylinder-insertion end of the shaft 20. The interference wheel 26 includes a plurality of arcuate indentions or notches 28 equidistantly spaced around the wheel 26 that form radially extending projections 27 therebetween. The notches 28 and projections 27 serve to respectively release or hold the cartridges 2 disposed in the cylinder chambers 48 of the reload cylinder 40, the details of which will be set forth below. The number of notches 28 corresponds to the number of cylinder chambers 48 in the reload cylinder 40.

Figure 4:
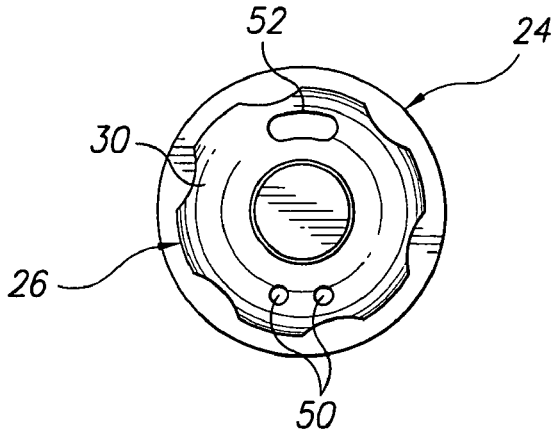
FIG. 4 is an end view of the shaft assembly of the firearm cartridge speed loader according to the present invention, as seen from the end opposite the knob.
Figure 6:
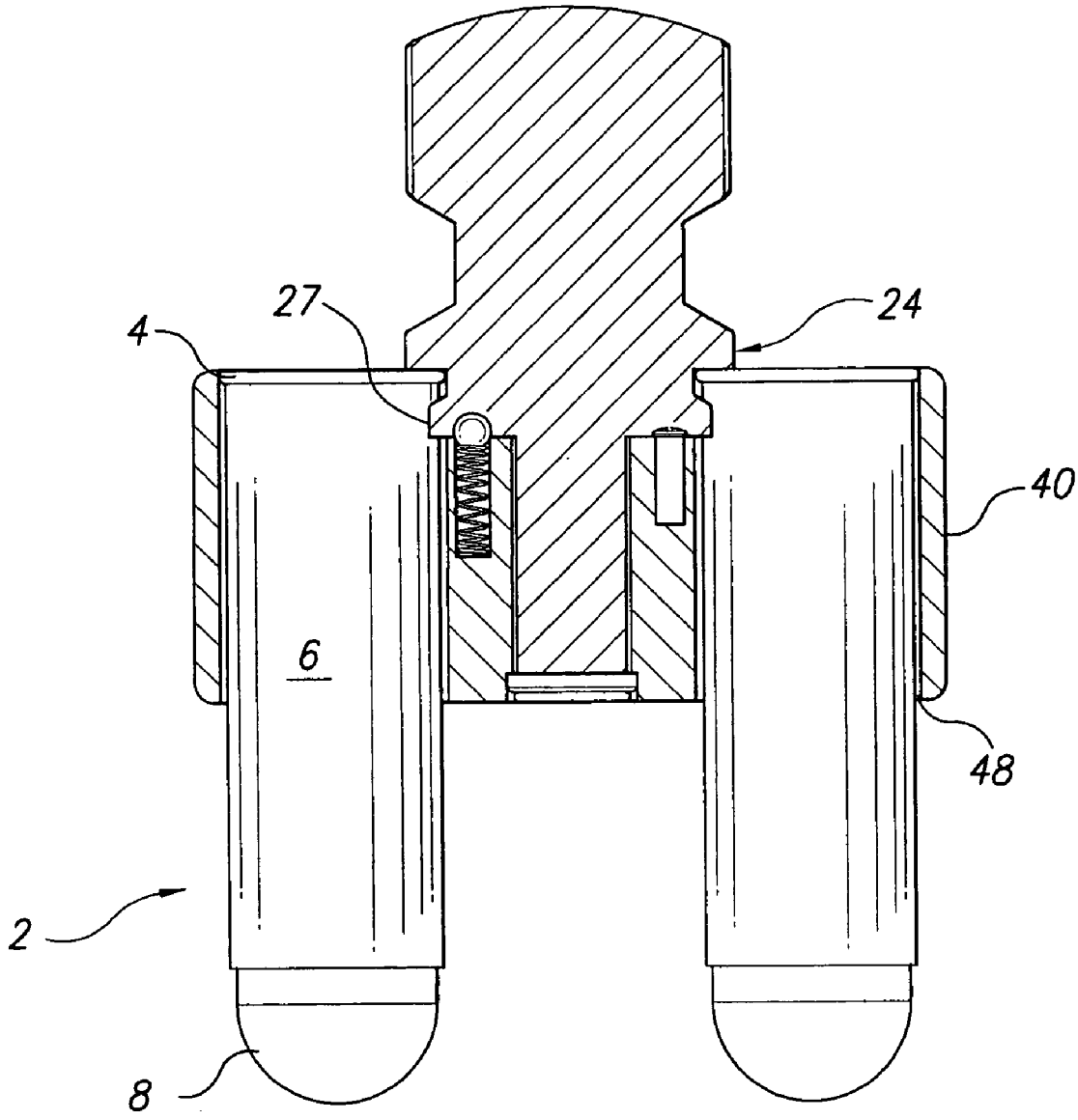
FIG. 6 is an environmental top view in section of the firearm cartridge speed loader according to the present invention, shown with cartridges being held by the loader.

One face of the interference wheel 26 has a sloped or beveled surface 29, while the opposite face 30 is substantially flat. The sloped surface 29 is angled towards the longitudinal axis of the shaft 20 and enables the projections 27 to slip beneath the rim 4 of a cartridge 2 to clamp the cartridge, as shown in FIG. 6. As shown in FIG. 4, the opposite face 30 of the wheel 26 contains a pair of hemispherical detents 50 radially spaced from the shaft 20 and an arcuate groove 52 diametrically opposite from the detents 50. The extent of the arc for the groove 52 and the spacing of the detents 50 correspond to each other. For example, if the groove 52 extends across an arc of 30°, then the detents 50 are spaced 30° from each other. The detents 50 and the groove 52 form a part of a rotation limit assembly, the details of which will be explained below. Representative dimensions of the interference wheel 26 are approximately 0.622 inches in diameter and 0.090 inches in thickness.

Referring to FIG. 3, the shaft assembly 20 has an elongate cylindrical shaft portion 34. The cylindrical shaft portion 34 is substantially smaller in diameter than the diameters of the knob 21, the stop 24, and the interference wheel 26. The cylindrical shaft portion 34 is adapted to be inserted into the central bore 41 of the reload cylinder 40. The diameter of the cylindrical shaft portion 34 is about 0.250 inches and the length is about 0.600 inches. An annular groove 36 is formed at the lowermost portion of the cylindrical shaft portion 34 so that a snap ring or retaining clip 60 may be snapped therein to prevent the shaft assembly 20 from sliding out of the reload cylinder 40 once the two parts are assembled.

Turning now to the reload cylinder 40, the reload cylinder 40 is a fluted cylinder having a plurality of cylinder chambers 48 arranged at regular intervals about the longitudinal axis of the reload cylinder 40. The reload cylinder 40 has representative dimensions of 1.700 inches in diameter and 0.750 inches in thickness. A bullet cartridge 2 includes a jacket 6 having a rim 4 at one end and a bullet or ammunition shell 8 held at the other end. Each of the cylinder chambers 48 is adapted to loosely house at least a portion of the jacket 6 due to the diameter of the cylinder chamber being slightly larger than the diameter of the cartridge rim 4. The fluting or curved indentions 44 around the outside of the reload cylinder 40 provides a substantial savings in overall weight of the reloader 10. The fluting 44 also simulates the look of a typical revolver cylinder 1, which may be employed to assist the user in aligning the cartridges 2 for insertion into the chambers of the revolver cylinder 1 by matching the respective fluting, either by sight or touch. A bore 41 is centrally formed in the reload cylinder 40 and adapted to receive the cylindrical shaft portion 34.

Figure 5:
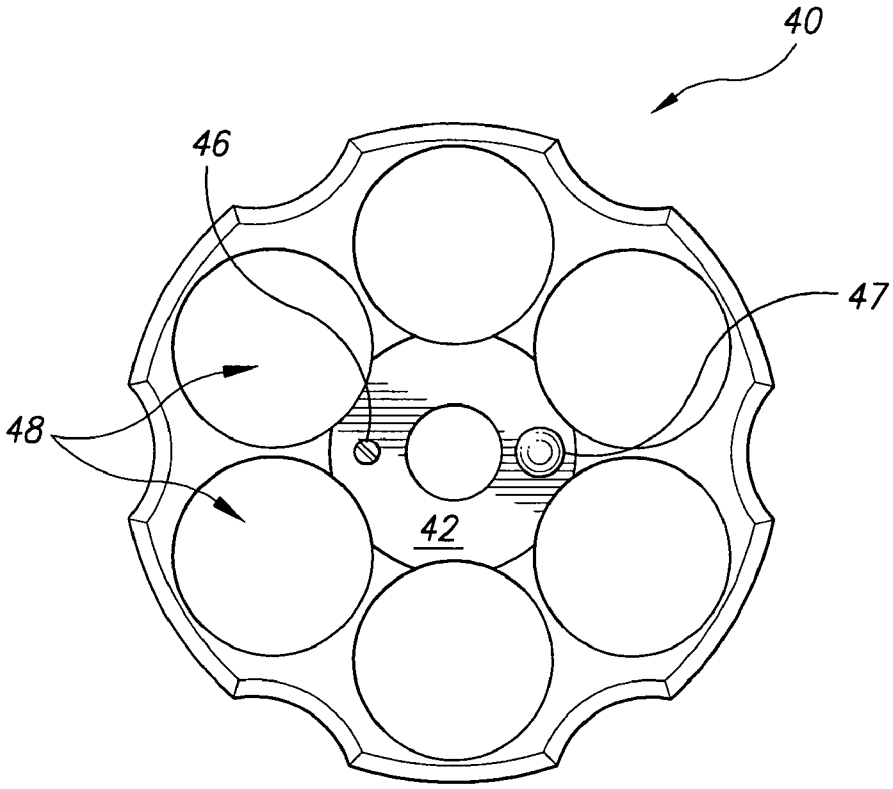
FIG. 5 is an end view of the reload cylinder of the firearm cartridge speed loader according to the present invention, as seen from the end facing the shaft assembly.

As shown in FIGS. 3 and 5, the end of the reload cylinder 40 is machined to form a first circular recess 42 defining a seat for the interference wheel 26. Thus, the depth and diameter of the first circular recess 42 correspond to the thickness and diameter of the interference wheel 26. A dowel or rotation stop pin 46 and an opposing spring-loaded or spring-biased spherical ball 47 are disposed on the surface of the first circular recess 42. Both the pin 46 and the biased ball 47 form another part of the aforementioned rotation limit assembly, the details of which will be explained below. The rotation stop pin 46 extends parallel to the longitudinal axis of the reload cylinder 40.

The opposite end of the reload cylinder 40 includes another or second machined circular recess 50 but with a smaller diameter than the first circular recess 42. During assembly, the lowermost portion of the cylindrical shaft portion 34 projects into the second circular recess 50 to be substantially flush with the plane of the end of the reload cylinder 40. The second circular recess 50 provides room to mount the retaining clip 60 in the annular groove 36.

When the shaft assembly 20 and the reload cylinder 40 are assembled, the seat in the first circular recess 42 forms an interface between the two. At the interface, the rotation limit assembly includes the rotation-stop pin 46 riding in the arcuate groove 52 and the spring-biased detent ball 47 selectively engaging the detents 50 whenever the knob 21 is turned to clamp/retain or release the cartridges 2 housed in the cylinder chambers 48. The detent ball 47 is biased by a spring 49. As shown in FIG. 4, the arcuate groove 52 defines the limits and guides the angular movement of the shaft 20, and the respective opposing detents, vis-à-vis the interaction with the biased ball 47, alternately lock the shaft assembly 20 into cartridge-clamping or -retaining position or cartridge-releasing position.

Figure 8:
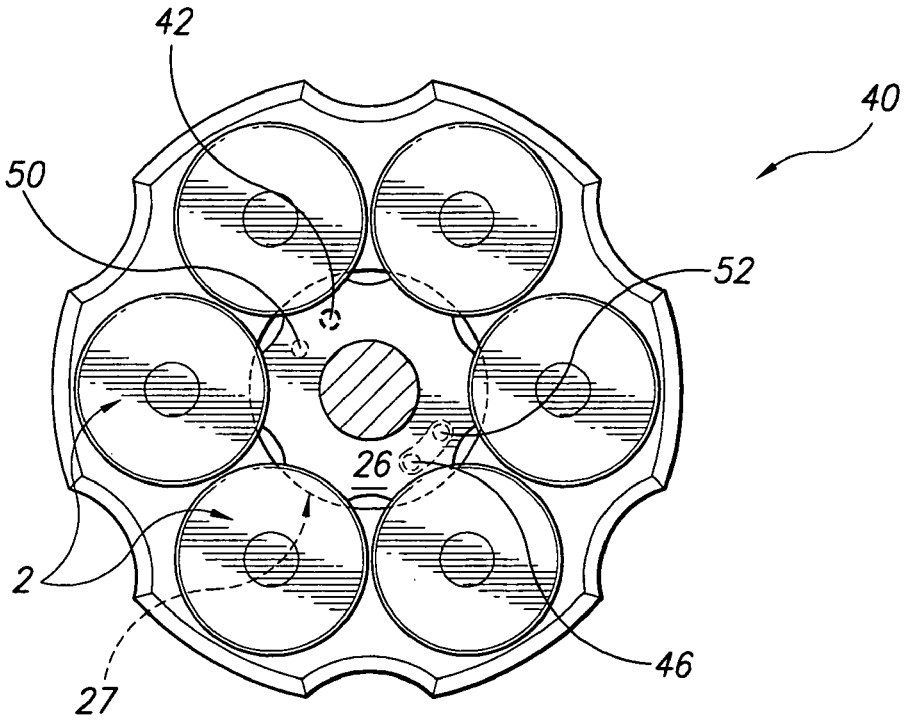
FIG. 8 is a schematic end view in partial section of the firearm cartridge speed loader according to the present invention, showing the position of the interference wheel corresponding to FIG. 6, with the cartridges being held by the loader.

The following explains the operation of the firearm speed loader 10. FIGS. 6 and 8 respectively show the firearm speed loader 10 in a cartridge-clamping or cartridge-retaining state. The rotation-stop pin 46 rests at one extreme end of the arcuate groove 52 while the detent ball 47 engages a corresponding detent 50 diametrically opposite from the groove extreme end. The stop 24 partially overlies the opening of the cylinder chambers 48 so that the rear of the cartridge 2 may abut the stop 24 and not fall out of the cylinder chamber. As the knob 21 is turned in one direction to reach the cartridge-retaining state, the sloped surface 29 of the projections 27 insures that the projections 27 may easily slide under the rim 4 of the cartridge 2 as the projection 27 gradually extends into the chamber 48 of the reload cylinder 40. The projections 27 extend far enough to interfere with the jacket 6 and thereby clamp the cartridge 2 against the inner wall of the respective pockets.

Figure 7:
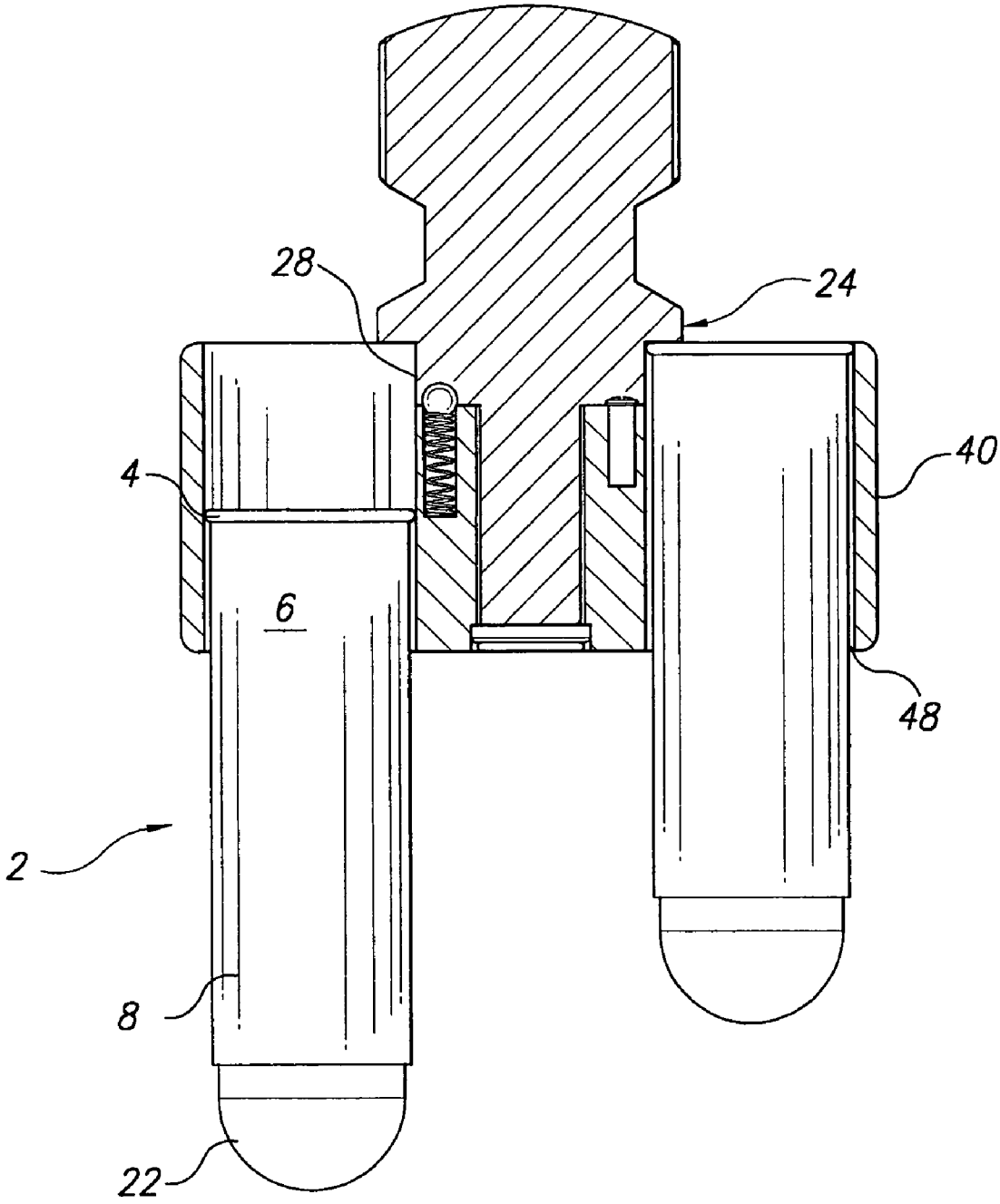
FIG. 7 is an environmental top view in section of the firearm cartridge speed loader according to the present invention, shown in a cartridge-releasing position.
Figure 9:
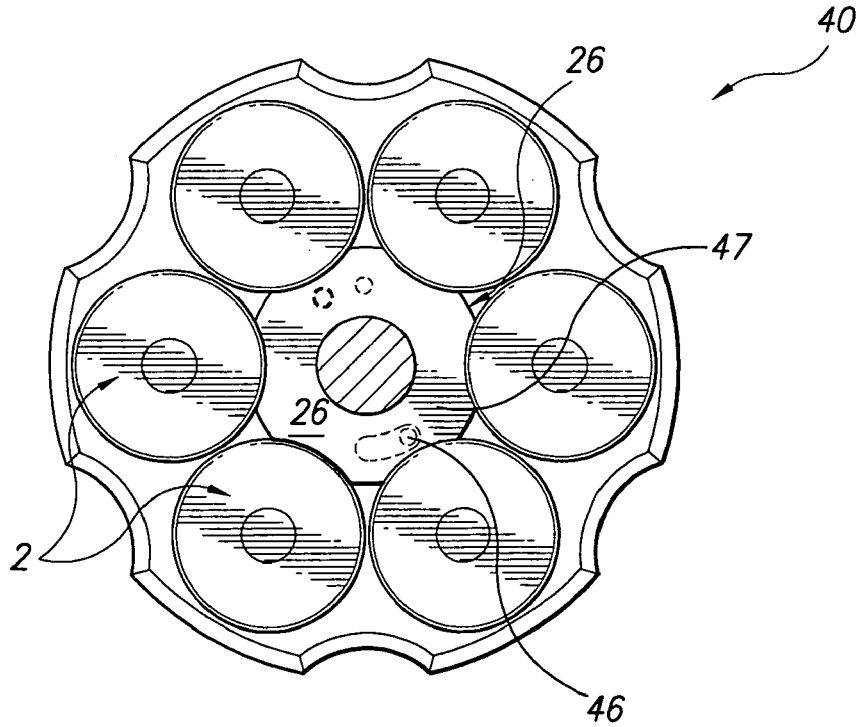
FIG. 9 is a schematic end view in partial section of the firearm cartridge speed loader according to the present invention, showing the position of the interference wheel corresponding to FIG. 7, with the loader in the cartridge-releasing position.

FIGS. 7 and 9 respectively show the firearm speed loader 10 in a cartridge-releasing state. To release the cartridges 2 to load a firearm, the knob 21 is turned in the opposite direction, which causes the rotation-stop pin 46 to ride in the arcuate groove 52 a predetermined angular amount until the other extreme end of the groove 36 is reached. At the same time, the detent ball 47 is forcibly disengaged from the current detent until it rests in the remaining detent 50 when the rotation-stop pin 46 abuts the other extreme end. Meanwhile, concurrent rotation of the interference wheel 26 reveals the releasing indentions 28 at the cylinder chambers 48, thus forming an uninterrupted passage for the cartridges 2 to fall into the chambers of the revolver cylinder 1.

As discussed above, once the fresh cartridges 2 have been fed into the firearm speed loader 10, a simple twist of the knob 21 insures a secure clamping/retaining engagement of the cartridges 2 in the reloader 10. To reload a spent revolver, the user tactilely and/or by sight lines up the reloader to the revolver cylinder 1, with some assistance from the fluting 44, and twists the knob 21 in the opposite direction to release the cartridges into the chambers of the revolver cylinder.

It is noted that the present invention may encompass a variety of alternatives to the various features thereof. For example, the dimensions of the firearm cartridge speed loader 10 may be changed to facilitate different caliber and/or number of cartridges 2. The firearm cartridge speed loader 10 is preferably made from aluminum, but any other lightweight and durable material may be used, e.g., the reload cylinder 40 may be made from hard plastic. The placement of the rotation stop pin 46, the arcuate groove 52, the detent ball 47, and the detents 50 may be interchangeably disposed between the interference wheel 26 and the first circular recess 42, so long as the configuration permits the pin 46 to ride in the groove 52 and the detent ball 47 to engage the detents 50. The firearm cartridge speed loader 10 may also have an anodized coating for wear resistance and long life, and the coating has an additional benefit of preventing or reducing oxidation of the metal.

It is to be understood that the present invention is not limited to the embodiments described above, but encompasses any and all embodiments within the scope of the following claims.

We claim:

1. A firearm cartridge speed loader, comprising:

a shaft assembly having:

a cylindrical shaft having a first end and a second end;

a stop disposed on the cylindrical shaft between the first and second ends; and an interference wheel disposed on the cylindrical shaft between the stop and the second end of the cylindrical shaft for rotation therewith, the interference wheel having a pair of detents defined therein;

a reload cylinder having a plurality of cylinder chambers extending radially about the reload cylinder, the chambers being adapted for receiving firearm cartridges, the reload cylinder having a central bore defined therein, the second end of the cylindrical shaft being rotatably disposed in the bore, the reload cylinder having a face having an arcuate groove defined therein facing the shaft assembly;

a rotation-limit assembly disposed between the interference wheel and the reload cylinder, the rotation-limit assembly including:

a rotation stop pin extending parallel to the reload cylinder central bore, the stop pin sliding in the arcuate groove to define the limits of rotational angular movements of the shaft assembly; and a detent ball alternately engaging the detents in the interference wheel to lock the angular position of the shaft assembly at the defined limits, the shaft assembly being rotatable between a holding position in which the firearm cartridges are retained in the reload cylinder and a release position in which the cartridges are released from the reload cylinder for loading into a firearm; and a snap ring engaging the second end of the cylindrical shaft to retain the reload cylinder on the shaft assembly.

2. The firearm cartridge speed loader according to claim 1, further comprising a knob disposed on the first end of said cylindrical shaft, the knob being adapted for grasping by a user.

3. The firearm cartridge speed loader according to claim 2, wherein said knob further has a plurality of arcuate indentions equidistantly spaced around said knob, the indentations forming a plurality of radially extending protuberances.

4. The firearm cartridge speed loader according to claim 3, wherein said knob has indicia at a top portion thereof.

5. The firearm cartridge speed loader according to claim 2, wherein said knob is knurled.

6. The firearm cartridge speed loader according to claim 1, wherein said stop comprises a disk having a diameter dimensioned to at least partially cover a portion of each of the chambers to prevent the cartridges from falling out of the reload cylinder.

7. The firearm cartridge speed loader according to claim 1, wherein said interference wheel comprises a disk having a sloped face and an opposite face, the disk having a plurality of notches equidistantly spaced around the disk, the notches defining projections therebetween, the projections extending under a rim of the cartridges in the holding position to retain the cartridges in the reload cylinder, the notches being aligned with the cylinder chambers to permit release of the cartridges in the release position.

8. The firearm cartridge speed loader according to claim 7, wherein the detents and the arcuate groove are diametrically opposite each other.

9. The firearm cartridge speed loader according to claim 1, wherein said reload cylinder has a fluted body, a first recess formed on one face forming a seat for said interference wheel, and a second recess formed on an opposing face for receiving the snap ring.

10. The firearm cartridge speed loader according to claim 1, wherein said reload cylinder is made from durable, substantially lightweight material.

11. The firearm cartridge speed loader according to claim 10, wherein said material is aluminum.

12. The firearm cartridge speed loader according to claim 11, wherein said reload cylinder has an anodized coating.

13. The firearm cartridge speed loader according to claim 12, wherein said reload cylinder is made of plastic.

* * * * *